United States Patent [19]

Galow et al.

[11] 4,392,919

[45] Jul. 12, 1983

[54] CHARGING APPARATUS FOR COKE COOLING CHAMBERS

[75] Inventors: Manfred Galow; Horst Joseph, both of Essen, Fed. Rep. of Germany

[73] Assignee: Didier Engineering GmbH, Fed. Rep. of Germany

[21] Appl. No.: 243,381

[22] Filed: Mar. 13, 1981

[30] Foreign Application Priority Data

Mar. 26, 1980 [DE] Fed. Rep. of Germany ..... 3011575

[51] Int. Cl.[3] ..... C10B 39/02; C10B 39/12

[52] U.S. Cl. ..... 202/228; 202/263

[58] Field of Search ..... 202/228, 227, 230, 229; 201/39

[56] References Cited

U.S. PATENT DOCUMENTS 4,024,023 5/1977 Jonnet ..... 202/228
4,028,192 6/1977 Bender et al. ..... 202/227
4,066,513 1/1978 Jablin ..... 202/227
4,092,222 5/1978 Kataoka et al. ..... 202/228

*Primary Examiner*—Bradley Garris
*Attorney, Agent, or Firm*—Wood, Herron & Evans

[57] ABSTRACT

An apparatus for charging coke chambers is disclosed which effectively reduces and controls gas and dust emissions evolved during the coke charging operation. The charging apparatus includes a gas-tight enclosure which seals the immediate area surrounding the cooling chamber or serially arranged chambers in a cooling plant, a lift transport facility located internally to the enclosure for carrying a coke bucket to and from the respective coke cooling chambers, a crane or elevator for placing and removing the coke bucket from the lift transport facility, and an exhaust device for evacuating the gas and dust emissions from the enclosure. Inert gas feedlines are integrated with the charging operation to maintain an inert gas atmosphere within the enclosure.

10 Claims, 5 Drawing Figures

Inertgas
II-II
III-III
3,4

IV-IV

CHARGING APPARATUS FOR COKE COOLING CHAMBERS

BACKGROUND OF THE INVENTION

This invention relates to a charging apparatus for coke cooling chambers and, more specifically, to an apparatus for reducing dust and gas emissions in coke cooling chambers of a coke drying plant, which chambers are either solitary or arranged side by side, and which are charged by a coke bucket which is transported above the coke chamber and placed on its charging opening.

A sealing device for a coke cooling chamber has been described in the German patent disclosure 28 15 739. This sealing device makes it possible to keep the cooling chamber tightly sealed both in the charging and in the cooling operations. An upper and lower lid on the charging opening of the cooling chamber are provided for this purpose, the lids being alternately operated. The coke bucket features a sealing device which is complementary with the upper lid. As the coke bucket is emptied into the cooling chamber, gas and dust enters the coke bucket. However, since this gas and dust cannot be removed with this sealing device, it is necessary to reduce these emissions to the greatest extent possible.

The problem underlying this invention is to provide a charging device for coke cooling chambers which permits the removal of the gases or dust occurring during the charging operation.

BRIEF DESCRIPTION OF THE INVENTION

The problem of controlling the dust and gas emissions is solved by the present invention by extending the coke chamber or chambers into an essentially gastight enclosure in the area of the charging opening or openings. In a multiple chamber cooling plant, the coke bucket used for charging the hot coke is rolled into the enclosure and positioned on the coke chamber to be charged by means of a transport facility which is accessed through a closable opening in the enclosure. An exhaust device for the gas/air mixture evolved in the charging operation as well as an inert gas feedline are connected to the enclosure.

The coke bucket rolled into the enclosure can be emptied into the selected coke chamber once the enclosure is completely sealed. Gases or dust entering the enclosure during charging will not escape outside, but are evacuated from the enclosure. Emissions accumulating in the coke bucket can be permitted to enter the enclosure, and will be similarly removed during evacuation of the enclosure. Inert gas is subsequently admitted into the interior of the enclosure for pressure equalization and maintaining the inert atmosphere.

The arrangement for a plant with several coking chambers is preferably designed such that the charging openings of the plant extend into a common enclosure. A transport system is provided consisting essentially of an elevator and/or crane for placing the coke bucket in the enclosure, and a lift type carriage for the horizontal movement of the coke bucket across the various coke chambers. The enclosure covers all of the coke chambers, specific sealing measures for each individual coke chamber are therefore dispensed with. The sealable enclosure opening for accessing the interior may be arranged in the enclosure roof, on the underside, or on the side of the enclosure depending on the type of coke bucket elevator employed.

In a preferred embodiment of the invention, the carriage of the transport facility is arranged inside the enclosure. It is rolled into the area of the elevator and/or crane for pickup and/or return of the coke bucket, the bucket is placed through the enclosure opening onto the lifting device of the carriage by means of the elevator and/or crane. The coke chambers of a plant are preferably arranged on both sides of the enclosure opening, carriages are therefore provided for transport of the charging bucket, one on each side. This makes it possible to place a full coke bucket on a carriage and immediately thereafter lift an empty coke bucket from the other carriage with the aid of the elevator and/or crane, whereafter the next full coke bucket is rolled into the enclosure. This results in a speedy transfer operation. The time saved in comparison to the usual transfer operation permits a longer shuttle time for coke buckets between the coke furnace and the coke cooling chambers. This is beneficial especially in cases where coke dry cooling chambers are coordinated with a coke furnace battery in a manner where construction of the coke dry cooling chambers near the coke furnace is not possible.

In another embodiment of the invention, the horizontal transport facility is combined with the elevator and/or crane itself, with a sealable enclosure opening provided in the enclosure roof above each of the coke chambers. The coke bucket is in this case moved above the selected coke chamber with the aid of the elevator and/or crane, and lowered into the enclosure through the respective opening. A carriage for the coke bucket is not required in this case.

A carriage for the coke bucket is also not required in the case of a solitary coke chamber. In this embodiment, the coke bucket is placed directly on the coke chamber with the aid of the elevator and/or crane.

In another embodiment of the invention, the transport facility may be incorporated with the elevator and/or crane itself, with a single enclosure opening provided on the underside or side of the enclosure. The coke bucket is lifted or pushed through the enclosure opening with the aid of the elevator or crane and subsequently rolled to the selected coke chamber inside the enclosure. Any component which extends through the enclosure wall, for instance, a crane cable or a crane arm, is provided with a slot in the enclosure wall or roof which is fitted for maintaining the gastight seal in the enclosure.

This invention can be utilized equally well with or without a coke dry cooling prechamber.

Other objects and advantages of this invention will become apparent from the following detailed description of the invention.

DETAILED DESCRIPTION OF THE INVENTION

Figures 1, 2, 3:
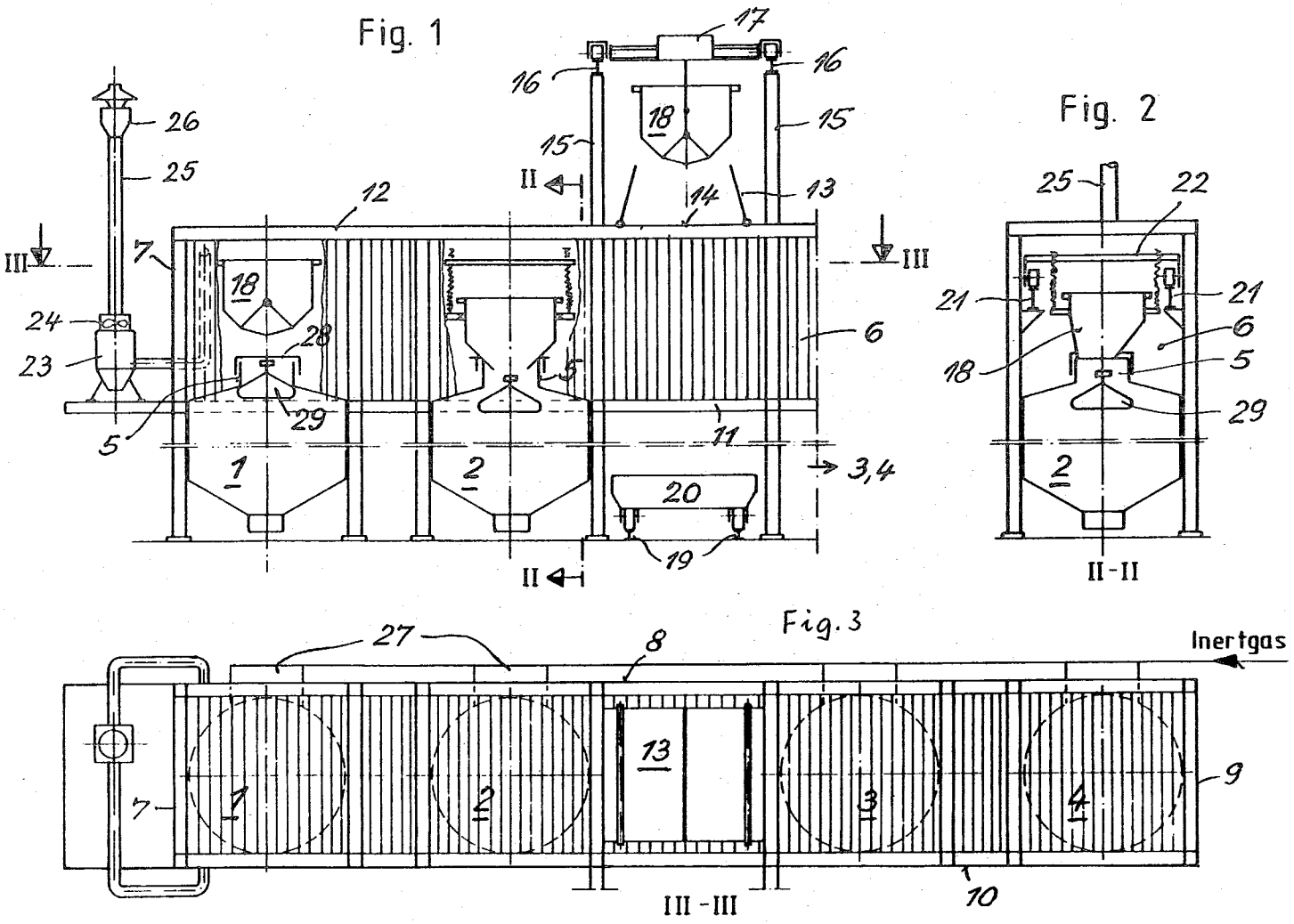
FIG. 1 is a partial front elevation of a coke dry cooling plant with the charging apparatus of the invention for several coke dry cooling chambers, and partially cut away in the area of the left coke cooling chambers. Illustration of the coke cooling chambers located to the right of center are omitted.
FIG. 2 is a sectional illustration of the charging apparatus along line 2—2 of FIG. 1.
FIG. 3 is a plan view of the charging apparatus, partly in cross-section along the line 3—3 of FIG. 1.

Referring now to FIGS. 1–3, four coke dry cooling chambers 1, 2, 3 and 4 are located side by side with an enlarged space in the center of the row. Hoppers 5 of the chambers 1 through 4 extend into the enclosure 6. Sidewalls 7 through 10 form the enclosure sides. A continuous floor 11 of the enclosure 6 fits closely around the chambers 1 through 4. An opening 14 is provided in the center of the roof 12 of the enclosure 6 above the space between the two center chambers 2 and 3. The opening 14 can be sealed essentially gas tight by means of doors 13. Attached to a support frame 15 located above the opening 14 are rails 16 on which a crane 17 is movable. In the position illustrated in FIG. 1, the crane 17 is holding a coke bucket 18 above the opening 14 while the doors 13 are partially open.

Directly below the rails 16 on which the crane 17 runs, in the area of the center space, are further rails 19 on which a coke bucket carriage 20 is carried from a coke furnace battery (not illustrated).

Further rails 21 are arranged inside the enclosure 6 which extend transversely to rails 16 and 19. At least one carriage 22 can be shuttled on these rails 21.

A gas/air exhaust device with a filter 23, a suction blower 24, and a chimney 25 are connected to the enclosure 6. The top of the chimney 25 is provided with a device 26 serving to flare off the gases exhausted from the enclosure 6. This exhaust device is operable only when the enclosure 6 is closed.

Several blockable feedlines 27 are connected to the enclosure 6 through which an inert gas is admitted to the interior of the enclosure 6. The introduction of the inert gas into the enclosure 6 prevents any penetration of oxygen into the enclosure 6 in the event of leakage. Further, when the enclosure 6 is opened, the escaping inert gas prevents oxygen from entering the enclosure. The closures of these inert gas feedlines 27 operate in conjunction with the closing of the enclosure 6 and the operation of the gas/air mixture exhaust device 23–26.

The operation of the described charging apparatus of this invention is approximately as follows.

With the doors 13 to the enclosure 6 open, a coke bucket 18, which has been carried by the coke bucket carriage 20 to a point directly below the crane 17, is picked up by the crane 17 and moved into position above the enclosure 6, as illustrated in FIG. 1. From this position, the coke bucket 18 is then placed on the carriage 22, which has been rolled underneath the opening 14. It is then rolled to a position above one of the cooling chambers 1 through 4, for instance, above the chamber 1 or 2. In the meantime, an emptied coke bucket 18 can be picked up from the chamber 3 or 4 on the other side of the enclosure 6 with a second carriage 22, and shuttled underneath the opening 14 where it will be picked up by the crane 17 and lowered onto the bucket carriage 20.

Next, the doors 13 and with them the opening 14 are closed, so that the enclosure is now essentially sealed against the surrounding atmosphere. After a cover 28 has been lifted from the charging hopper 5 and moved sideways, the carriage 22 places the coke bucket 18 on the respective cooling chamber 1 or 2 while the cooling chamber closure 29 is opened simultaneously. This is illustrated in FIGS. 1 and 2 for the chamber 2. The coke then drops from the coke bucket 18 into the cooling chamber. Any escaping dustladen gases are permitted to accumulate in the enclosure 6. Following the dumping of the coke bucket 18 and the closing of the charged cooling chamber by means of the closure 29 and/or the cover 28, an opening on the coke bucket 18 (not illustrated) is released so that the gases which have accumulated in the bucket can escape into the enclosure 6. Meanwhile, the suction blower 24 is operating exhausting the enclosure 6 and the empty coke bucket 18. The accumulated gases are thereby evacuated through the chimney 25 and flared off with the aid of the device 26. The dust is retained by the filter 23. Next, after the enclosure 6 has been completely closed again, the feedlines 27 are opened for the admission of inert gas into the enclosure 6.

In the meantime, another filled coke bucket has been rolled up for charging a second coke chamber 3 or 4 on the other side of the cooling plant. The now emptied coke bucket 18 is shuttled to the opening 14 with the aid of the carriage 22. The doors 13 are opened, and the crane 17 lifts a filled coke bucket 18 into the enclosure 6 in the manner previously described. Upon releasing the filled coke bucket 18, the crane 17 immediately picks up the empty coke bucket 18 and removes it from the enclosure 6, lowering it thereafter onto the coke bucket carriage 20.

The blocking device of the feedlines 27 for the inert gas is interlocked with the operating device for the gas/air mixture exhaust device 23 through 26 such that no inert gas can flow into the enclosure 6 while the exhaust device 23 through 26 builds up the above-mentioned vacuum. Inert gas is admitted only when the exhaust device 23 through 26 has been blocked and shut off. All of the components of the charging apparatus are interlocked in terms of control and operation. The described operation of the apparatus can be fully automated with the aid of the appropriate control system. The cover 28 and the closure 29 for the cooling chambers 1–4 are a double seal. Due to the enclosure of this invention, a single seal is all that is necessary. For instance, the cover 28 is dispensable.

Figure 4:
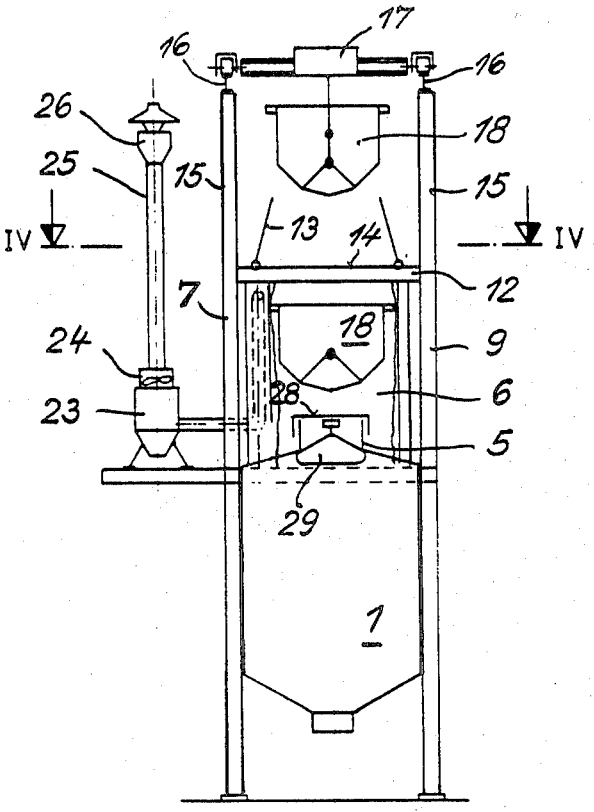
FIG. 4 is a front view of the charging apparatus for a single coke cooling chamber.
Figure 5:
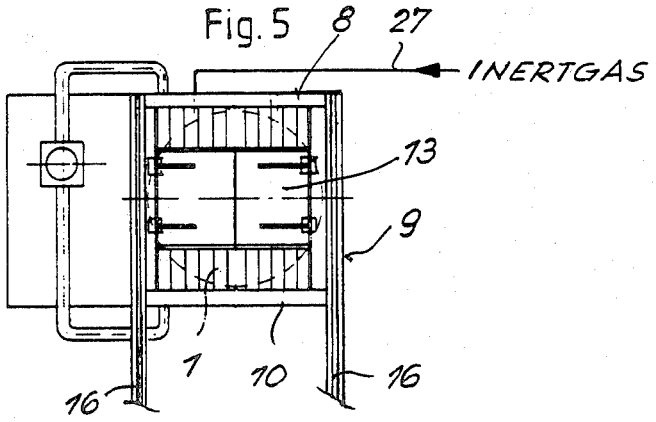
FIG. 5 is a sectional illustration along the line 4—4 of FIG. 4.

Referring to the solitary charging device of FIGS. 4 and 5, only a single cooling chamber 1 is to be charged. Consequently, the coke bucket 18 is placed directly on the hopper 5 with the aid of the crane 17. A carriage 22, illustrated in FIGS. 1 and 2, is not required since the function of the carriage being assumed by the crane 17. Otherwise, this embodiment operates in the same manner as described above for the multiple chamber plant.

The invention of this charging apparatus thus accomplishes not only an emissionless charging of the coke dry cooling chambers, but in addition, a hazard to the operating personnel is avoided since the discharge of CO gas is prevented. Although the invention has been described in terms of certain preferred embodiments, it will be appreciated that other forms may be adopted within the scope of the invention.

We claim:

1. In combination an apparatus for the dry cooling of coke including a dry coke cooling chamber and a charging opening in said chamber wherein hot coke is transferred by means of a coke bucket to said cooling chamber, charging apparatus for charging said coke cooling chamber with said hot coke comprising:

an enclosure including a roof, a bottom and sides, said enclosure encompassing at least an upper portion of said cooling chamber such that the charging opening of the cooling chamber extends into the enclosure, said enclosure being essentially gastight when sealed, means for selectively opening and sealably closing an opening in said enclosure permitting access of said coke bucket to the interior of the enclosure, and sealing of said enclosure when said bucket is in the interior thereof for charging said coke to said cooling chamber, transport means for shuttling said coke bucket into and out of said enclosure and to said coke cooling chamber for charging said coke to said cooling chamber, exhaust gas treatment means for evacuating said enclosure of emissions generated by the charging of the cooling chamber and for controlling release of said emissions to the atmosphere, and gas feed means connected to said enclosure for supplying inert gas to the interior of the enclosure.

2. The combination of claim 1 wherein a plurality of coke cooling chambers are arranged side by side and wherein said transport means comprises lift means for moving said coke bucket into and out of said enclosure and a carriage for horizontally shuttling the coke bucket to a position above the coke cooling chambers.

3. The combination of claim 2 wherein said lift means comprises a crane.

4. The combination of claim 2 wherein said carriage is located inside said enclosure and is movable to a position for receiving or returning a coke bucket movable through said opening in said enclosure by said lift means.

5. The combination of claim 2 wherein the coke cooling chambers are arranged on opposite sides of said enclosure opening and the transport means is further comprised of at least two carriages, one on each side of the said enclosure opening.

6. The combination of claim 1 wherein said enclosure opening is located in said roof of said enclosure above said coke cooling chamber.

7. The combination of claim 1 wherein said enclosure opening is located in the bottom or sides of said enclosure and wherein said enclosure has a slot in said roof which can be sealed gastight and through which said transport means operates.

8. The combination of claim 1 wherein said exhaust gas treatment means includes a suction blower operative to exhaust said enclosure of said emissions.

9. The combination of claim 8 wherein said exhaust gas treatment means further comprises a filter located upstream of said suction blower and a chimney having means for flaring treated gas passing through said filter.

10. The combination of claim 1 wherein the gas feed means are operationally interlocked with said gas exhaust gas treatment means such that no inert gas is fed into the enclosure when said exhaust gas treatment means is operating.

* * * * *